US008877120B2

(12) United States Patent
Ebner et al.

(10) Patent No.: US 8,877,120 B2
(45) **Date of Patent: *Nov. 4, 2014**

(54) DEVICE FOR HEAT-TREATING SHEET METAL STRIPS

(75) Inventors: Robert Ebner, Leonding (AT); Eduard Morbitzer, Linz (AT)

(73) Assignee: EBNER Industrieofenbau GmbH, Leonding (AT)

( * ) Notice: Subject to any disclaimer, the term of this patent is extended or adjusted under 35 U.S.C. 154(b) by 299 days.

This patent is subject to a terminal disclaimer.

(21) Appl. No.: 13/501,555

(22) PCT Filed: Sep. 17, 2010

(86) PCT No.: PCT/AT2010/000340

§ 371 (c)(1),
(2), (4) Date: Apr. 18, 2012

(87) PCT Pub. No.: WO2011/044599

PCT Pub. Date: Apr. 21, 2011

(65) Prior Publication Data

US 2012/0200015 A1 Aug. 9, 2012

(30) Foreign Application Priority Data

Oct. 13, 2009 (AT) ..... A 1609/2009

(51) Int. Cl.
*C21D 9/54* (2006.01)
*F27D 99/00* (2010.01)
*F23C 3/00* (2006.01)

(52) U.S. Cl.
CPC ..... *F27D 99/0006* (2013.01); *F27D 99/0035* (2013.01); *F23C 3/002* (2013.01)
USPC ..... 266/108; 266/103

(58) Field of Classification Search
CPC ..... F27D 99/0035; F23C 3/002
USPC ..... 266/103, 108
See application file for complete search history.

(56) References Cited

U.S. PATENT DOCUMENTS

| | | | |
|---|---|---|---|
| 4,520,789 | A | 6/1985 | Rombouts |
| 5,042,452 | A | 8/1991 | Dubreuil et al. |
| 2011/0120453 | A1 | 5/2011 | Wünning et al. |
| 2012/0223466 | A1 | 9/2012 | Ebner et al. |

FOREIGN PATENT DOCUMENTS

| | | | |
|---|---|---|---|
| CN | 201246745 | Y | 5/2009 |
| DE | 93 06 007 | | 10/1993 |

(Continued)

OTHER PUBLICATIONS

International Search Report of PCT/AT2010/000340, date of mailing Jan. 26, 2011.

*Primary Examiner* — Scott Kastler
(74) *Attorney, Agent, or Firm* — Collard & Roe, P.C.

(57) ABSTRACT

A device is described for heat-treating sheet metal strips (6), comprising at least one radiant tube unit (1) which has three tubes disposed in a common plane parallel to the sheet metal strip (6), namely a middle tube (2) that can be connected to a burner and two outer tubes (3) that are connected at both ends to the middle tube (2) by means of tube bends (4), and a bearing (8) on the side of the radiant tube unit (1) opposite the burner for a bearing journal (9) connected to the two tube bends (4) between the middle tube (2) on the one hand and the two outer tubes (3) on the other hand, the bearing journal engaging in a journal receptacle (10) of the bearing (8) in an axially displaceable manner. In order to provide advantageous constructional conditions it is proposed that an insert (16) forming a sliding layer (15) is provided in the support area of the bearing journal (9) between the journal receptacle (10) of the bearing (8) and the bearing journal (9).

3 Claims, 2 Drawing Sheets

(56) References Cited

FOREIGN PATENT DOCUMENTS

| | | | | |
|---|---|---|---|---|
| DE | 20 2008 009 065 | | | 10/2008 |
| EP | 0 383 687 | | | 8/1990 |
| GB | 2198486 | A | * | 6/1988 |
| JP | 8-278003 | | | 10/1996 |
| JP | H09-303713 | A | | 11/1997 |

* cited by examiner

DEVICE FOR HEAT-TREATING SHEET METAL STRIPS

CROSS REFERENCE TO RELATED APPLICATIONS

This application is the National Stage of PCT/AT 2010/000340 filed on Sep. 17, 2010 , which claims priority under 35 U.S.C. §119 of Austrian Application No. A 1609/2009 filed on Oct. 13, 2009 , the disclosure of which is incorporated by reference. The international application under PCT article 21(2) was not published in English.

1. Field of the Invention

The invention relates to a device for heat-treating sheet metal strips, comprising at least one radiant tube unit which has three tubes disposed in a common plane parallel to the sheet metal strip, namely a middle tube that can be connected to a burner and two outer tubes that are connected at both ends to the middle tube by means of tube bends, and a bearing on the side of the radiant tube unit opposite the burner for a bearing journal connected to the two tube bends between the middle tube on the one hand and the two outer tubes on the other hand, the bearing journal engaging in a journal receptacle of the bearing in an axially displaceable manner.

2. Description of the Prior Art

It is known for the heat treatment of sheet metal strips (DE 20 2008 009 065 U1) to provide radiant tube units which are heatable by means of burners and which comprise two outer tubes which originate from a middle tube connected to the burner and are disposed parallel to the middle tube in a common axial plane, so that a respective partial flow of the hot exhaust gases of the burner flowing into the middle tube can be guided in a circuit with the help of the outer tubes which are connected on the end side via tube bends to the middle tube. The sheet metal strip to be treated, which is conveyed parallel to the common axial plane of the tubes of the radiant tube unit with a direction of feed extending transversely to the tube axes, is heated by way of the heat radiation emitted by the tubes of the radiant tube unit. Due to the high temperatures of the radiant tubes, the bearing of the radiant tube unit must be arranged in such a way that at least the thermal expansions of the tubes in the axial direction need to be taken into account. For this purpose, the middle tube between the burner and the outer tubes is axially held in a pivot bearing, while at the opposite ends of the radiant tube unit a usually hollow bearing journal which is welded to the two tube bends connecting the ends of the middle tube with the ends of the outer tubes is supported in an axially displaceable manner in a bearing. As a result of the high treatment temperatures of 750° C. to 900° C. for example, the strength even of high-temperature steel will suffer, leading to the likelihood of caking together of the bearing journal in the bearing. The prevention of the axial journal movement in the bearing leads to deformations of the radiant tubes and consequently to damage which can lead to a standstill of the device.

SUMMARY OF THE INVENTION

The invention is therefore based on the object of providing a device of the kind mentioned above for the heat treatment of sheet metal strips in such a way that damage to the radiant tube unit as a result of thermal expansions can be substantially excluded.

This object is achieved by the invention in such a way that an insert forming a sliding layer is provided in the support area of the bearing journal between the journal receptacle of the bearing and the bearing journal.

By providing an insert with a sliding layer between the bearing journal and the journal receptacle of the bearing, caking of the bearing journal in the journal receptacle can be prevented in a simple way, so that the sliding accommodation of the bearing journal in the bearing can be ensured even at high temperatures. The precondition is a sliding layer which has sufficient temperature resistance, as is provided advantageously for example in sliding layers made of a ceramic material. By providing an insert forming the sliding layer in the support area of the bearing journal between the journal receptacle and the journal, simple constructional conditions are obtained because the insert, which is preferably a respectively formed sheet metal part, can simply be coated with a sliding layer as a separate component. Moreover, the sliding layer is subjected to a far from inconsiderable wear and tear as a result of the comparatively high weight loads by the radiant tube unit, so that an exchangeable insert forming the sliding layer would entail special advantages when it is intended to renew the sliding layer. It is merely necessary to remove the insert and to replace the same with a newly coated one or by a new insert.

BRIEF DESCRIPTION OF THE DRAWINGS

The subject matter of the invention is shown by way of example in the drawings, wherein.

DESCRIPTION OF THE PREFERRED EMBODIMENT

Figure 1:
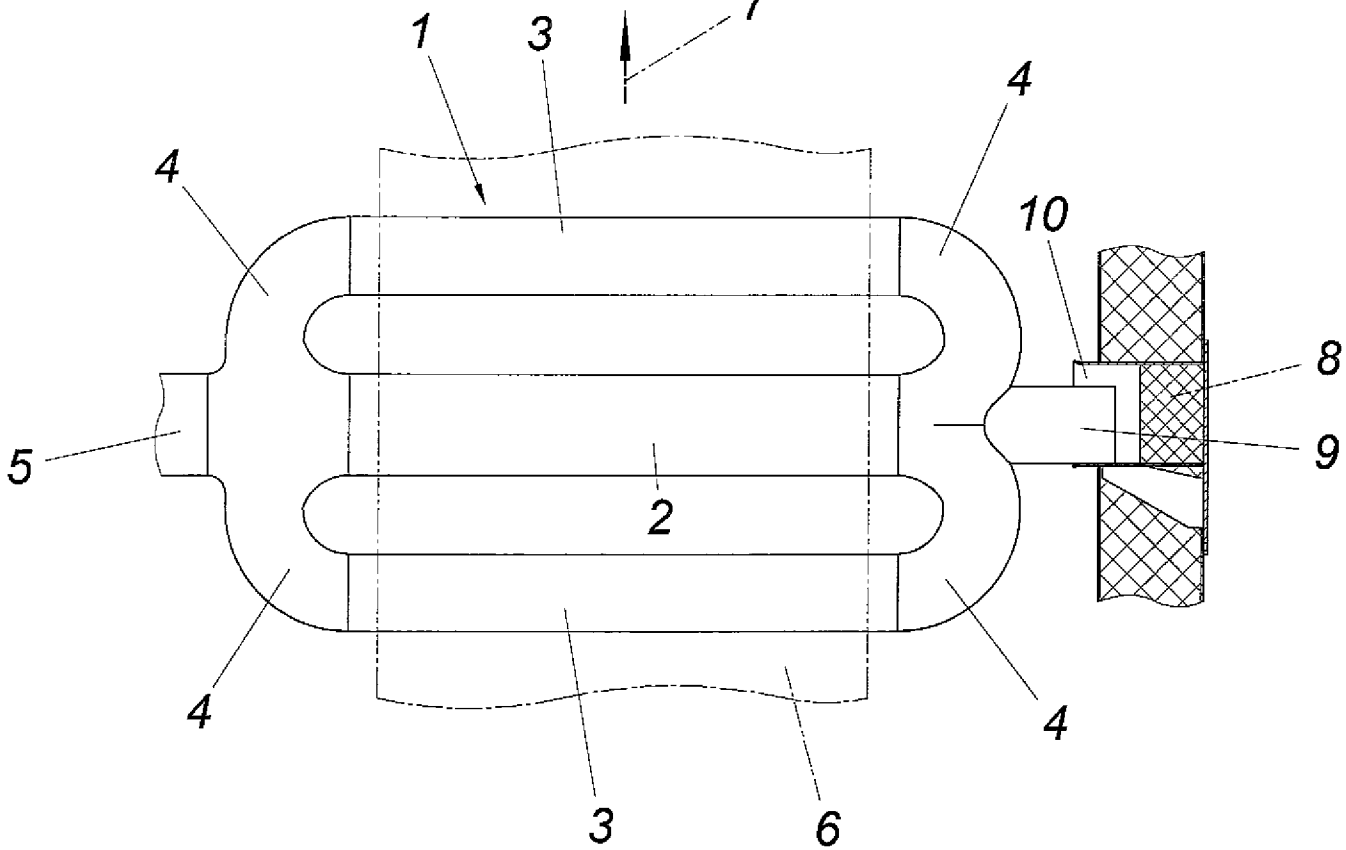
FIG. 1 shows a device in accordance with the invention for the heat treatment of sheet metal strips in a section in the region of the radiant tube unit in a simplified side view.

The illustrated device for the heat treatment of sheet metal strips comprises according to FIG. 1 at least one radiant tube unit 1 which comprises a middle tube 2 and two parallel outer tubes 3 which are disposed together with the middle tube 2 in a common axial plane. The outer tubes 3 are respectively flow-connected to the middle tube 2 via tube bends 4 at the end side. The hot exhaust gases flowing into the middle tube 2 from a burner connected to an extension 5 of the middle tube 2 are therefore partly guided in a circuit via the two outer tubes 3. A sheet metal strip 6 which is indicated by a dot-dash line is heated by means of the radiation heat emitted by the tubes 2, 3, which sheet metal strip is guided parallel to the common axial plane of the tubes 2, 3, namely in a direction of feed 7 which extends transversely to the tube axes.

The radiant tube unit 1 is mounted on both sides of the tubes 2 and 3, so that a substantially even distribution of the weight load is provided on the two lateral bearings. While the bearing which accommodates the extension 5 of the middle tube 2 and is not shown for reasons of clarity of the illustration axially fixes the radiant tube unit 1, the opposite bearing 8 supports the radiant tube unit 1 in an axially displaceable manner. For this purpose, the radiant tube unit 1 carries a usually tubular bearing journal 9 at the end of the middle tube 2 which is opposite of the extension 5, which bearing journal is supported in an axially displaceable manner in a sleeve-like journal receptacle 10. As is shown especially in FIG. 2, said sleeve-like journal receptacle 10 is arranged on a support plate 11 which is fastened to a wall 12 of a furnace frame accommodating the radiant tube unit 1 and protrudes through the thermal insulation 13 of the furnace wall 12 into the furnace chamber. The bearing 8 is also provided with a respective thermal insulation by a thermally insulated plug 14 within the journal receptacle 10.

Figure 3:
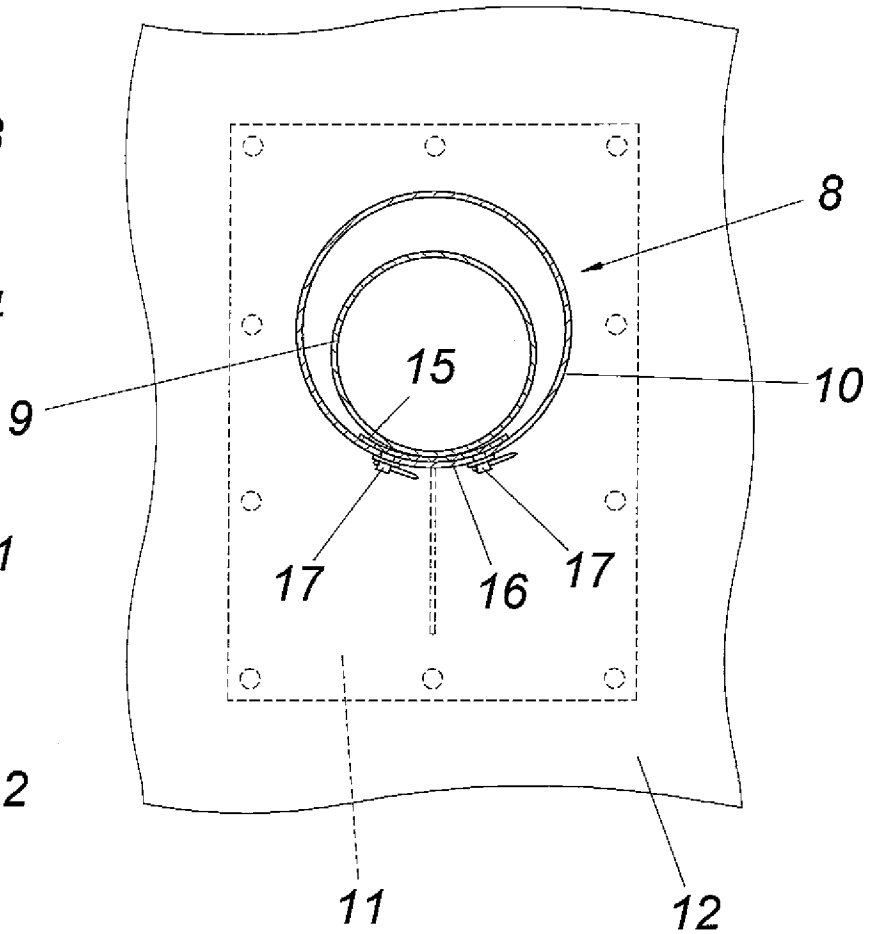
FIG. 3 shows a sectional view along the line III-III of FIG. 2.
Figure 2:
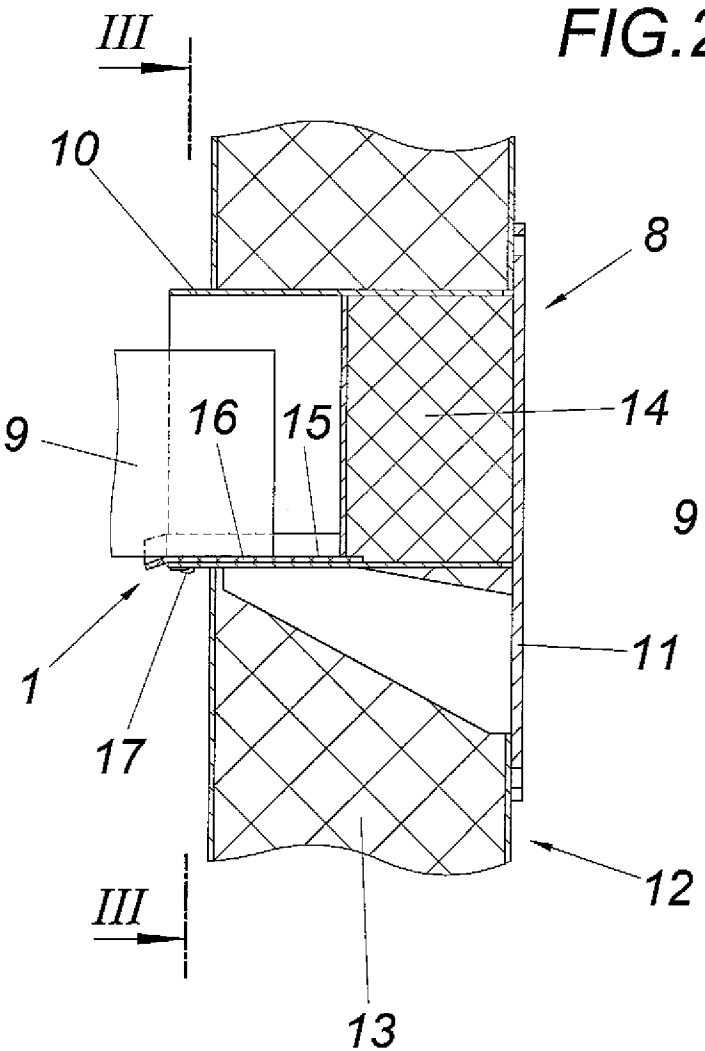
FIG. 2 shows the radiant tube unit in a section in the region of the bearing journal in a simplified sectional view through the bearing of the bearing journal on an enlarged scale.

In order to ensure that the bearing journal 9 can be supported in a sliding fashion in the journal receptacle 10 even under high temperature loads, the sleeve-like journal receptacle 10 is provided according to FIGS. 2 and 3 with an insert 16 forming a sliding layer 15, on which the journal 9 will rest, so that the sliding capability of the bearing journal 9 in relation to the bearing 8 is ensured by a respective sliding layer 15. Said insert 16 is held with the help of secured insertion journals 17 in the sleeve-like journal receptacle 10 and can therefore be exchanged in a simple way if wear and tear of the sliding layer 15 formed by said insert 16 requires such an exchange.

The sliding layer 15 of the insert 16 must therefore be arranged in a respectively temperature-resistant way. A sliding layer 15 made of a ceramic material advantageously fulfils these conditions. The axial relative movement between the bearing journal 9 and the bearing 8 which is required for the compensation of the thermal expansions of the tubes 2, 3 of the radiant tube unit 1 is therefore also ensured under the occurring high loads by the weight of the radiant tube unit 1 and the temperature conditions.

The invention claimed is:

1. A device for heat-treating sheet metal strips, the device comprising at least one radiant tube unit which has three tubes disposed in a common plane parallel to the sheet metal strip the three tubes comprising a middle tube that can be connected to a burner and two outer tubes that are connected at both ends to the middle tube via tube bends, and a bearing on the side of the radiant tube unit opposite the burner for a bearing journal connected to the two tube bends between the middle tube on the one hand and the two outer tubes on the other hand, the bearing journal engaging in a journal receptacle of the bearing in an axially displaceable manner, wherein an insert forming a sliding layer is provided in the support area of the bearing journal between the journal receptacle of the bearing and the bearing journal.

2. The device according to claim 1, wherein the insert forming the sliding layer is exchangeably held in the journal receptacle of the bearing.

3. The device according to claim 1, wherein the sliding layer is made of a ceramic material.

* * * * *

UNITED STATES PATENT AND TRADEMARK OFFICE

CERTIFICATE OF CORRECTION

PATENT NO. : 8,877,120 B2
APPLICATION NO. : 13/501555
DATED : November 4, 2014
INVENTOR(S) : Ebner et al.

It is certified that error appears in the above-identified patent and that said Letters Patent is hereby corrected as shown below:

In the Claims

In particular, In Column 4, line 5 (Line 4 of Claim 1), after the word "strip" please insert: --,--.

Signed and Sealed this
Nineteenth Day of May, 2015

Michelle K. Lee

Michelle K. Lee
*Director of the United States Patent and Trademark Office*